United States Patent [19]

LaPointe, Jr.

[11] 4,010,684

[45] Mar. 8, 1977

[54] PRINTING DEVICE

[75] Inventor: Raymond J. LaPointe, Jr., Bloomfield Hills, Mich.

[73] Assignee: Detroit Ball Bearing Company, Detroit, Mich.

[22] Filed: Sept. 22, 1975

[21] Appl. No.: 615,804

[52] U.S. Cl. ..... 101/382 MV; 101/377

[51] Int. Cl.[2] ..... B41F 27/02

[58] Field of Search ..... 101/382 MV, 370, 374, 101/377, 405, 406

[56] References Cited

UNITED STATES PATENTS

| | | | |
|---|---|---|---|
| 569,096 | 10/1896 | Etly | 101/377 |
| 1,102,104 | 6/1914 | Stigberg | 101/377 |
| 1,560,210 | 11/1925 | Chisholm | 101/377 |
| 1,607,388 | 11/1926 | Chisholm | 101/377 |
| 2,072,098 | 3/1937 | Davis et al. | 101/377 X |
| 2,746,389 | 5/1956 | Alessi, Jr. et al. | 101/377 |
| 3,670,646 | 6/1972 | Welch, Jr. | 101/382 MV |
| 3,714,894 | 2/1973 | Robinson | 101/382 MV |
| 3,857,224 | 12/1974 | Hewitt | 101/382 MV X |

FOREIGN PATENTS OR APPLICATIONS

| | | | |
|---|---|---|---|
| 520,163 | 3/1931 | Germany | 101/382 MV |
| 213,580 | 4/1925 | United Kingdom | 101/382 MV |

*Primary Examiner*—E. H. Eickholt
*Attorney, Agent, or Firm*—Whittemore, Hulbert & Belknap

[57] ABSTRACT

A printing device is provided having one portion which is a magnetic retainer to receive and hold a plate having indicia stamped thereon and another portion which is grooved to receive printing type.

1 Claim, 6 Drawing Figures

PRINTING DEVICE

BACKGROUND OF THE INVENTION

Currently, indicia is printed on plastic bags to indicate the contents of the bag. The bags are first printed with initial information by a printing company. The user than prints additional information on the bags in blanks which are left open by the original printer. The bags come in rolls. These rolls are fed through a printer by the user of the bags. Currently, the original printer prints a portion of the information which is to be on the bag while the user prints more specific information relating to the exact contents of the bags and other information relative to the proprietary name of the company which is the ultimate purchaser of the bag and contents for resale purposes.

The present invention provides a printing device which is capable of magnetically retaining a stamped plate having some indicia thereon and also to retain standard printing type which is received in grooves provided on the printing device.

SUMMARY OF THE INVENTION

A printing device and holder therefor is provided. The printing device is secured in the holder. The printing device comprises a metallic plate having a face. Permanent magnet means are provided in a portion of the face. A magnetic plate is magnetically retained by the magnet means. The plate has protruding indicia stamped thereon. A plurality of parallel spaced apart grooves are provided in the remaining portion of the face. Printing type is releasably received in the grooves. The printing type has a generally U-shaped configuration including a pair of leg elements spaced apart by an interconnecting web portion. Indicia type protrude from the web portions. The leg elements extend into adjacent grooves.

Figure 6:
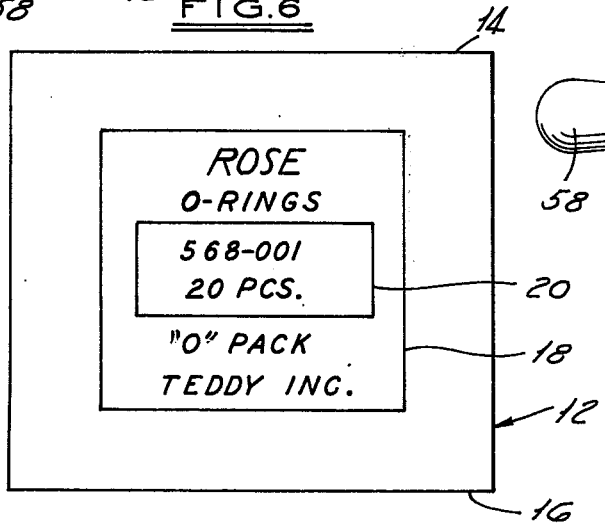
FIG. 6 is a view of a bag of the type in connection with which the printing device is utilized.

The printing device 10 is adapted for use in connection with printing of indicia on a plastic bag 12 of the type illustrated in FIG. 6. Such plastic bags are available in the form of long strips of individual bags connected together but easily severed by means of perforations provided between each adjacent bag along the upper and lower edges 14, 16. The long strips of bags are formed into rolls for ease of handling.

One widespread use of such bags is in connection with packaging of small industrial parts such as O-rings and the like. In the system for distribution of nationally known trademarked products, the manufacturer of the product frequently distributes the parts through companies which handle a large variety of different parts, this distribution company being able to service numerous manufacturers and smaller wholesalers with a wide variety of parts. The manufacturer thus has a central point of distribution while the wholesaler has a central source from which it may purchase its needs among a variety of products. This system of distribution thus works to the advantage of both the manufacturer and the wholesaler.

There is a problem however, in placing the desired indicia on the bags. The bags are initially purchased from a professional printing company. It is, of course, desirable that the professional printing company print as much indicia as possible on the bags because this is the least expensive way to have the bags printed. However, in view of the fact that the same size bags will be used in connection with different items and further that the name of the wholesaler is also frequently desirably printed on the bag, some of the printing must be done by the distributor, who is the user of the bags. Alternately, the distributor can have large rolls individually printed by the printing company for different wholesalers. However, this necessitates that the distributor keep a large inventory of the same size bags for the various different wholesalers who will ultimately be the purchasers of the contents.

Referring to FIG. 6 the original, professional printer will print an entire roll of bags with, for example, the trademark of the manufacturer and the product involved as illustrated "Rose O-rings". The original printer may also print the squares 18, 20. The square 18 may, for example, be red while the square 20 may, for example, be white to provide a visual separation of the information which is contained on the bag face. The square 20 will contain the specific information about the contents of the bag. As illustrated, the square 20 bears the indicia "568-001" which is the part number and "20PCS" which is the number of the parts in the bag. The same bag might later be used to package a different part number, such as an O-ring which is larger or smaller than the ones in the particular bag illustrated.

Beneath the square 20 there may be additional indicia printed indicating the name of the wholesaler to which the bag of parts will be sold and who will in turn resell the goods to a ultimate user. The wholesaler in the illustrated case is characterized as "Teddy Inc." The contents of the bag are characterized as being a "O-Pack".

In packaging of the illustrated O-rings No. "568001", the distributor may use a large number of such bags with the same part but for different wholesalers. Thus, a certain number of bags would be printed for "Teddy Inc." and then it might be desired to print from the same roll an additional number of bags for a different wholesaler. It will thus be seen that it would be desirable in the printing process for the distributor to be able to change the name of the wholesaler while still retaining the same parts identification.

Figure 4:
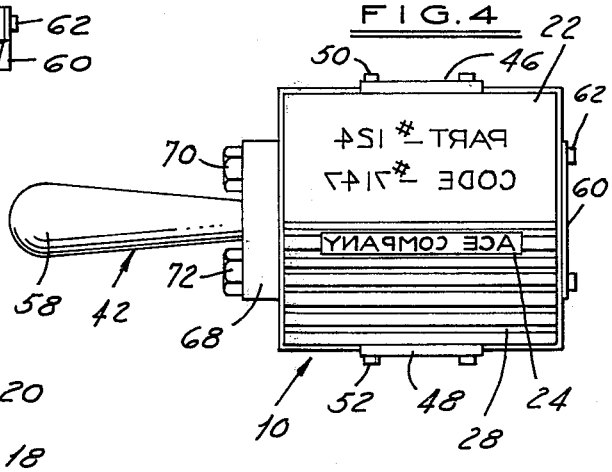
FIG. 4 is a view similar to FIG. 2 with a printing plate magnetically retained on the device along with lithotype print mechanically mounted on the device.

The most efficient way currently available for the type of printing involved is to provide a stamped plate 22 as illustrated in FIG. 4 which carries the indicia relative to the parts to be packaged in the bag. The most efficient way for printing the name of the individual wholesaler is to mechanically mount the name of the wholesaler by means of lithotype print 24. Heretofore, it has not been possible to provide both the stamped plate 22 and lithotype print 24 in the same printing device.

Figure 1:
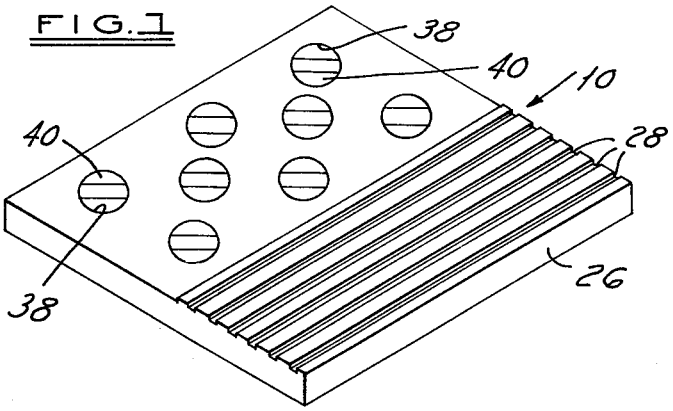
FIG. 1 is a view in perspective of a printing device in accordance with one embodiment of the present invention.
Figure 5:
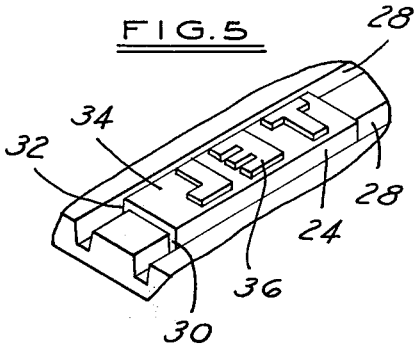
FIG. 5 is a view in perspective of a portion of the printing device illustrating the structure for mounting lithotype print.
Figure 2:
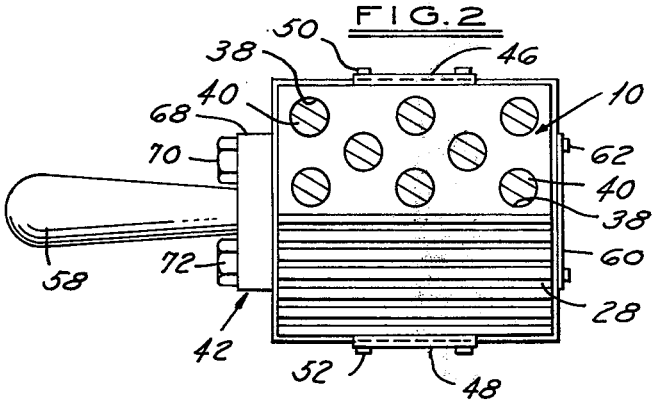
FIG. 2 is a top plan view of the printing device of FIG. 1 retained in its holder.
Figure 3:
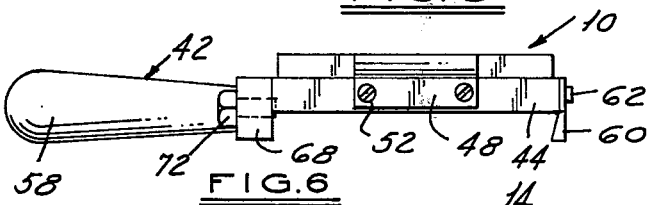
FIG. 3 is a side elevational view of the structure shown in FIG. 2.

The printing device 10 permits the desired combination of types of print. The printing device 10 comprises a generally rectangular metallic plate 26. Approximately one-half of the plate is provided with longitudinally extending, spaced apart grooves 28 for the reception of lithotype print 24. The lithotype print 24 may be provided as individual letters or as a single slug with the desired indicia integrated thereon. As shown in FIG. 5, a pair of adjacent grooves 28 form T-slotting for the lithotype print 24. The print 24 is generally U-shaped having legs 30, 32 which are received in the grooves 28 with a web 34 extending therebetween upon which raised letters 36 are provided.

The remaining portion of the printing device 10 is provided with a plurality of spaced apart recesses 38 which receive generally circular permanent magnets 40. The magnets 40 function to magnetically retain the plate 26, the plate 26 being fabricated of a magnetic material such as steel. The plate 26 may be an integral plate as shown or it may be made in two parts which are welded or secured together by means of fasteners.

The printing device 10 is retained in a holder 42. The holder 42 comprises a generally rectangular base element 44 having upstanding retainers 46, 48 on the sides thereof which are secured in place by means of Allen head screws 50, 52. Retaining pressure is applied to the printing device 10 by adjustment of the screws.

A handle 58 extends from the rearward portion of the element 44. The handle 58 permits manual manipulation of the structure. In the printing process, heat is utilized to imprint the indicia on the bags and the entire printing structure becomes quite hot. The handle 58, which is fabricated of a heat insulating type of material, permits manipulation of the structure even when it is hot.

A downwardly extending forward retainer 60 is provided for securing the structure in the printing machine. The retainer 60 is secured in place by means of screws 62. A downwardly extending element 68 is provided on the rearward end of the plate 44. A pair of screws 70, 72 threadingly engage openings in element 68 and extend slightly there beyond. The screws 70, 72 are utilized to securely fasten the structure to a printing machine.

As it will be appreciated, in operation, it is quite easy to mount the plate 22 and lithotype print 24 onto the printing device 10. During the course of a run of printing on a roll of bags, when it is desired to change the name of the wholesaler but not change the indicia indicating the contents of the bag, the printing machine is stopped, the printing structure is removed and new lithotype print is inserted in the grooves 28. The printing process then continues until it is again desired to change the name of a wholesaler. Of course, at any time desired, the indicia indicating the contents of the bag may also be changed. The entire process is quite efficient and has permitted a substantial reduction in the work hours necessary to print bags and also has permitted the distributor to substantially reduce the inventory of rolls of bags which he has in stock.

Having thus described my invention, I claim:

1. A printing device, a holder for said printing device, said printing device being mounted in said holder, said printing device comprising a metallic plate having a flat face, permanent magnet means provided on a portion of said face, said permanent magnet means comprising at least three permanent magnets, a plurality of spaced apart recesses provided on said portion of said flat face, each of said magents being received in one of said recesses, a flat magnetic plate releasably retained on said flat face by said magnet means, said flat metallic plate having protruding indicia stamped thereon, a plurality of parallel spaced apart grooves provided in the remaining portion of said flat face, printing type releasably received in said grooves, said printing type having a generally U-shaped configuration including a pair of leg elements spaced apart by an interconnecting web portion, indicia type protruding from said web portion, said leg elements extending into adjacent grooves.

* * * * *